US006686884B2

(12) United States Patent
Back et al.

(10) Patent No.: US 6,686,884 B2
(45) Date of Patent: Feb. 3, 2004

(54) MICROCHIP DUAL BAND ANTENNA

(75) Inventors: Seok Hyun Back, Incheon-shi (KR); Jin Myeong Kim, Seoul (KR); Byeong Gook Kim, Daejeon-shi (KR); Dae Hyeon Jeong, Seoul (KR); Yeong Jo Kang, Kyunggi-do (KR); Hyeok Joo Kwon, Kangseo-gu (KR)

(73) Assignee: Kosan I & T Co., Ltd., Seoul (KR)

( * ) Notice: Subject to any disclaimer, the term of this patent is extended or adjusted under 35 U.S.C. 154(b) by 0 days.

(21) Appl. No.: 10/199,150

(22) Filed: Jul. 18, 2002

(65) Prior Publication Data

US 2003/0214441 A1 Nov. 20, 2003

(30) Foreign Application Priority Data

May 15, 2002 (KR) ..... 2002-0026836

(51) Int. Cl.[7] ..... H01Q 1/38
(52) U.S. Cl. ..... 343/700 MS; 343/702; 343/895
(58) Field of Search ..... 343/702, 700 MS, 343/895, 873

(56) References Cited

U.S. PATENT DOCUMENTS 5,870,066 A * 2/1999 Asakura et al. ..... 343/895
6,023,251 A * 2/2000 Koo et al. ..... 343/895
6,124,831 A * 9/2000 Rutkowski et al. .. 343/700 MS
6,166,694 A * 12/2000 Ying ..... 343/702

* cited by examiner

*Primary Examiner*—Hoang V. Nguyen
(74) *Attorney, Agent, or Firm*—Snell Wilmer L.L.P.

(57) ABSTRACT

Disclosed is a microchip dual band antenna mounted to a printed circuit board having a ground surface and a non-ground surface. The microchip dual band antenna comprises first and second patch elements respectively surrounding both lengthwise ends of a dielectric body having a shape of a quadrangular prism; a first radiation patch separated from the first patch element and placed on an upper surface of the dielectric body to extend zigzag toward the second patch element; a second radiation patch joined to the second patch element and placed on a lower surface of the dielectric body to extend zigzag toward the first patch element by a distance less than one half of an entire length of the dielectric body, in a manner such that zigzag configurations of the first and second radiation patches are staggered with each other; and a first feeder channel defined on a front surface and adjacent to one end of the dielectric body and plated in such a way as to connect the first and second radiation patches.

3 Claims, 9 Drawing Sheets

Marker 1: 824 MHz

Marker 2: 894 MHz

Marker 3: 1,850 MHz

Marker 4: 1,990 MHz

Marker 1: 824 MHz

Marker 2: 894 MHz

Marker 3: 1,850 MHz

Marker 4: 1,990 MHz

Marker 1: 1:2.8486
880 MHz
Marker 2: 1:2.5007
960 MHz
Marker 3: 1:2.9314
1,710 MHz
Marker 4: 1:3.3695
1,880 MHz Marker 1: 23.813Ω
880 MHz
Marker 2: 29.068Ω
960 MHz
Marker 3: 30.939Ω
1,710 MHz
Marker 4: 154.80Ω
1,880 MHz GSM Gain : 0 dBi DCS Gain : 2 dBi

MICROCHIP DUAL BAND ANTENNA

This application claims priority of Korean Patent Application Serial No. 10-2002-0026836 filed on May 15, 2002.

FIELD OF INVENTION

The present invention relates to a microchip dual band antenna, and more particularly, the present invention relates to a microchip dual band antenna which can achieve in two frequency bands a return loss and a voltage standing wave ratio (VSWR) appropriate to a communication terminal, accomplish a satisfactory radiation pattern, be minimized in its size, and be internally mounted to various radio communication equipment in a miniaturized state.

BACKGROUND OF THE INVENTION

These days, with miniaturization of portable mobile communication terminals, internal mounting type antennas have been disclosed in the art. Further, as various communication services are rendered, in order to ensure high communication quality, microchip antennas, which are small-sized, lightweight and capable of overcoming disadvantages of external mounting type antennas, have been developed. Among the microchip antennas, a dual band antenna is highlighted since it can satisfy several kinds of services in an integrated manner.

However, in the conventional art, a drawback exists in that the microchip antenna cannot properly solve problems associated with miniaturization and design of a communication terminal, and it is inherently difficult to expand a bandwidth in the dual band antenna. In particular, since most of the conventional antennas are externally mounted to the communication terminal, impedance matching circuits are employed, and therefore, the number of processes and a manufacturing cost are increased.

SUMMARY OF THE INVENTION

Accordingly, the present invention has been made in an effort to solve the problems occurring in the related art, and an object of the present invention is to provide a microchip dual band antenna which can achieve a return loss and a VSWR appropriate to a dual band, accomplish a satisfactory radiation pattern, and be internally mounted to various radio communication equipment in a miniaturized state.

In order to achieve the above object, according to the present invention, there is provided a microchip dual band antenna mounted to a printed circuit board having a ground surface and a non-ground surface, comprising: first and second patch elements respectively surrounding both lengthwise ends of a dielectric body having a shape of a quadrangular prism; a first radiation patch separated from the first patch element and placed on an upper surface of the dielectric body to extend zigzag toward the second patch element; a second radiation patch joined to the second patch element and placed on a lower surface of the dielectric body to extend zigzag toward the first patch element by a distance less than one half of an entire length of the dielectric body, in a manner such that zigzag configurations of the first and second radiation patches are staggered with each other, and a first feeder channel defined on a front surface and adjacent to one end of the dielectric body and plated in such a way as to connect the first and second radiation patches.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION

Figure 1:
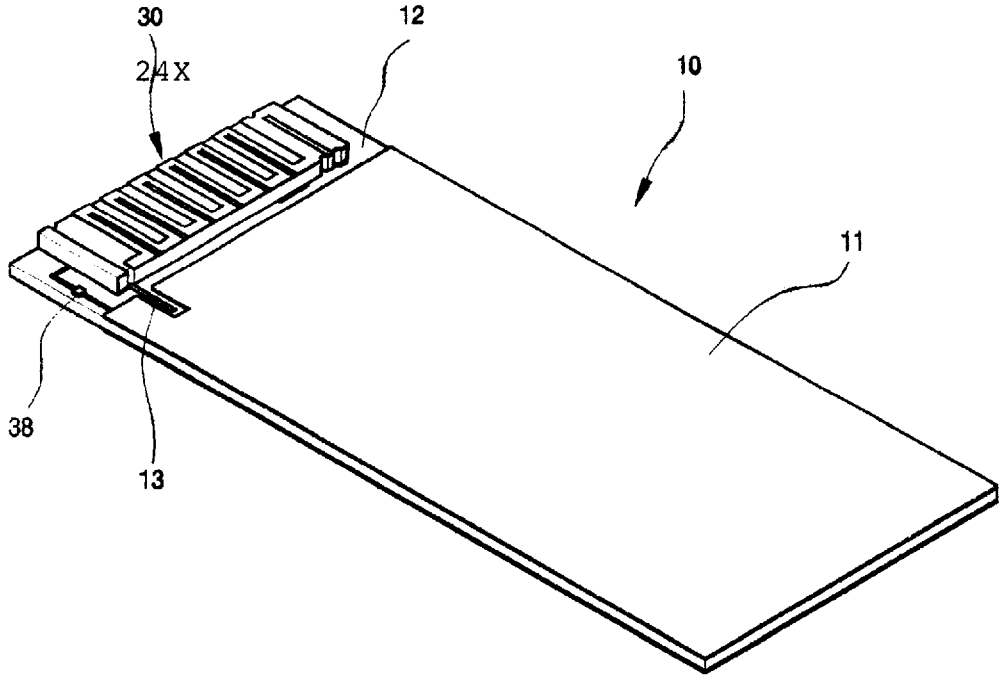
FIG. 1 is a perspective view illustrating a state wherein a microchip dual band antenna according to the present invention is surface-mounted to a printed circuit board.

Reference will now be made in greater detail to a preferred embodiment of the invention, an example of which is illustrated in the accompanying drawings. Wherever possible, the same reference numerals will be used throughout the drawings and the description to refer to the same or like parts.

With the advent of the information era, as an individual's social and economic activities are gradually increased and importance of information transmission is emphasized, a system for allowing a person to exchange information irrespective of time, place and the other party is needed.

In order to meet this need, a personal communication service (PCS) phone serving as a next-generation mobile communication system provides at a reasonable service charge a communication quality approaching to that of a wired telephone, realizes portability, miniaturization and light weight, and contributes to construction of a multimedia communication environment by affording data service, etc.

Meanwhile, in a digital mobile handset which is developed to improve limited channel capacity, low communication quality, degraded performance, etc. of an analog communication system, by the fact that voice is coded in its entirety, security is ensured, errors can be easily corrected, an interference-resistant characteristic is improved, and channel capacity is increased.

Multiple access methods used in a digital communication network are divided into a code division multiple access (CDMA) and a time division multiple access (TDMA). Capacity of each channel is limited by a frequency bandwidth and an assigned time. It is to be noted that, even in the case of digital type cellular mobile communication, a problem may be caused due to multipath fading and frequency reuse.

At this time, in the case of CDMA, no limitation is imposed on frequency reuse. However, in the case of TDMA, in order to reuse the same frequency, two cells must be sufficiently separated from each other so that they are not interfered with each other.

A group special mobile (GSM) employing the TDMA method is a cellular system which is operated in the 900 MHz band dedicated for the entire European area. The GSM system provides advantages in terms of signal quality, service charge, international roaming support, frequency band utilization efficiency, and so forth.

A personal communication network (PCN) which is obtained by upbanding the GSM serves as a digital cellular system (DCS) which is operated in the 1,800 and 1,900 MHz bands. Since the PCN is based on the GSM and employs a subscriber identification module (SIM), its roaming with the GSM is enabled.

The present invention is related with a microchip dual band antenna 30 which can be reliably used in a dual band including GSM and DCS bands. Detailed description thereof will be given hereafter.

FIG. 1 is a perspective view illustrating a state wherein the microchip dual band antenna 30 according to the present invention is surface-mounted to a printed circuit board 10. The printed circuit board 10 has a ground surface 11 and a non-ground surface 12. The microchip dual band antenna 30 is mounted to the non-ground surface 12 of the printed circuit board 10. In a preferred embodiment of the present invention, the printed circuit board 10 has a width of 38 mm and a length of 90 mm, the ground surface 11 has a width of 38 mm and a length of 78 mm, and the non-ground surface 12 has a width of 38 mm and a length of 12 mm. The microchip dual band antenna 30 is formed of a dielectric body 31 to reduce a manufacturing cost.

Figure 2:
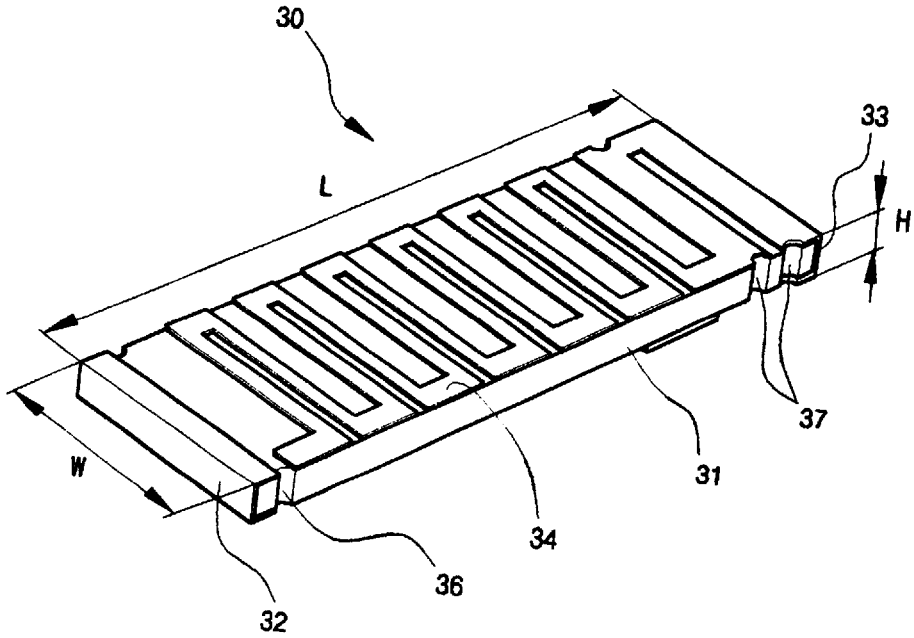
FIG. 2 is a perspective view independently illustrating the microchip dual band antenna according to the present invention.
Figure 3:
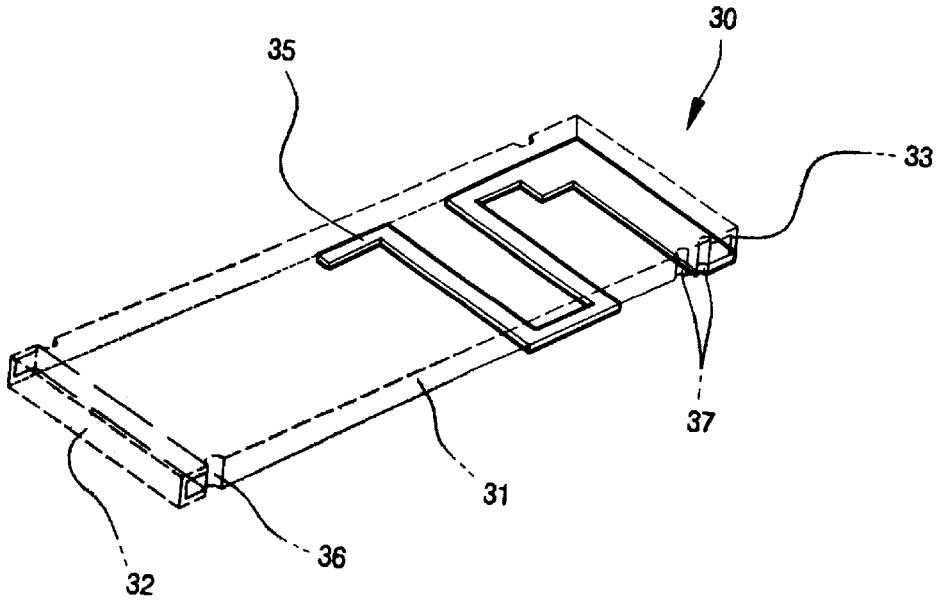
FIG. 3 is a partial perspective view illustrating a lower part of the microchip dual band antenna according to the present invention.

FIG. 2 is a perspective view independently illustrating the microchip dual band antenna 30 according to the present invention. In this preferred embodiment of the present invention, the dielectric body 31 which is formed into the shape of a quadrangular prism has a length L of 30 mm, a width W of 8 mm and a height H of 3.2 mm. FIG. 3 is a partial perspective view illustrating a lower part of the microchip dual band antenna 30 according to the present invention. By omitting or contouring the dielectric body 31 using a dashed line, an appearance of the lower part can be confirmed.

Figure 4:
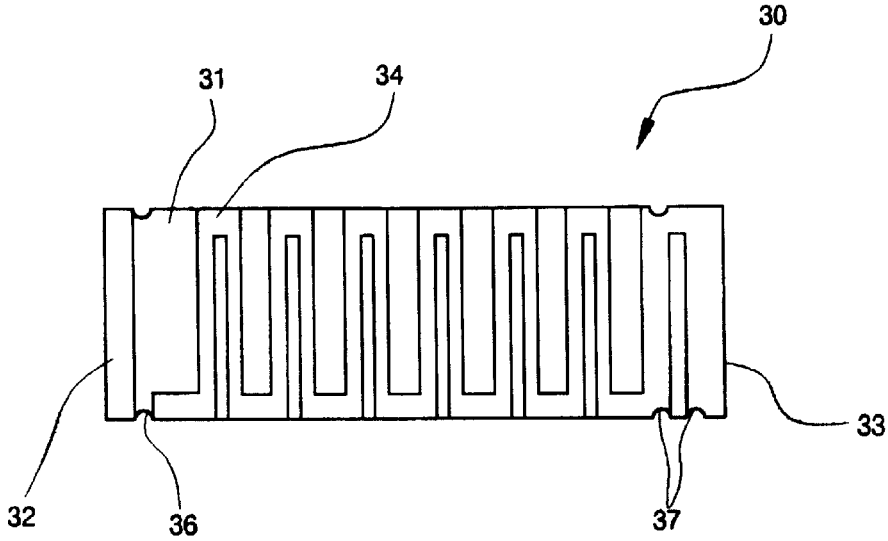
FIG. 4 is a plan view illustrating the microchip dual band antenna according to the present invention.
Figure 5:
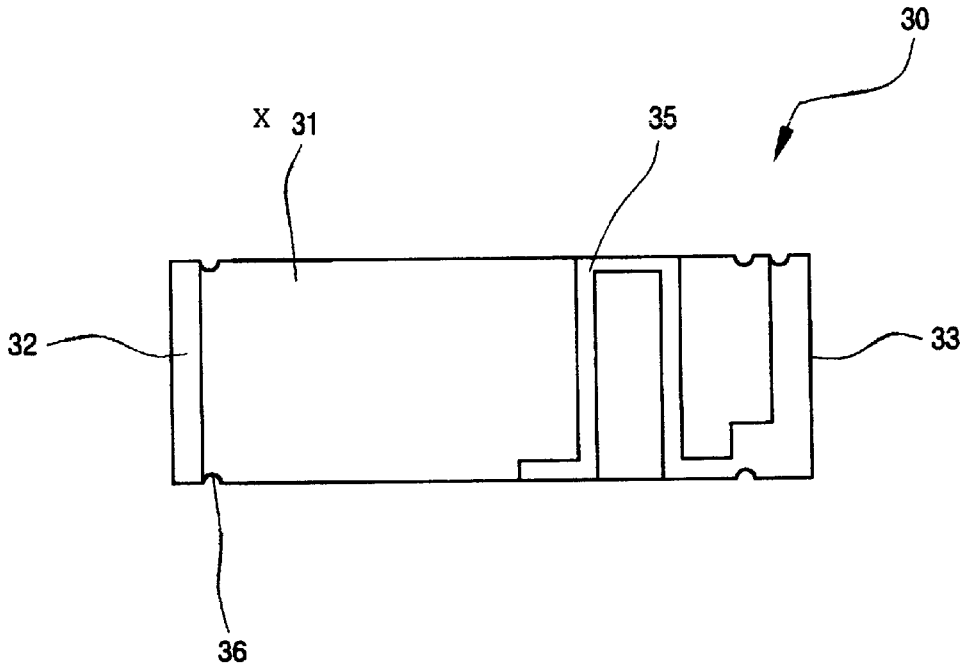
FIG. 5 is a bottom view illustrating the microchip dual band antenna according to the present invention.

FIG. 4 is a plan view of the microchip dual band antenna 30 according to the present invention, clearly illustrating a first radiation patch 34, and FIG. 5 is a bottom view of the microchip dual band antenna 30 according to the present invention, clearly illustrating a second radiation patch 35.

As shown in FIGS. 1 through 5, the microchip dual band antenna 30 according to the present invention includes first and second patch elements 32 and 33 which respectively surround both lengthwise ends of the dielectric body 31 having the shape of a quadrangular prism.

The first radiation patch 34 is separated from the first patch element 32 and placed on an upper surface of the dielectric body 31 to extend zigzag toward the second patch element 33. The first radiation patch 34 resonates, for example, in a GSM band. The second radiation patch 35 is joined to the second patch element 33 and placed on a lower surface of the dielectric body 31 to extend zigzag toward the first patch element 32 by a distance less than one half of an entire length L of the dielectric body 31, in a manner such that zigzag configurations of the first and second radiation patches 34 and 35 are staggered with each other. The second radiation patch 35 resonates, for example, in a DCS band.

Since the first and second radiation patches 34 and 35 are respectively placed on the upper and lower surfaces of the dielectric body 31 so that their zigzag configurations are staggered with each other, radiation influence and interference between them can be minimized. In one embodiment, the first radiation patch 34 can be operated in the 900 MHz band using the entire length L of the dielectric body 31, and the second radiation patch 35 can be operated in the 1,800 or 1,900 MHz band using one half of the entire length L of the dielectric body 31.

A first feeder channel 36 is defined on a front surface and adjacent to one lengthwise end of the dielectric body 31. The first feeder channel 36 is plated in such a way as to connect the first and second radiation patches 34 and 35 with each other. Second feeder channels 37 are defined on the front surface and adjacent to the other lengthwise end of the dielectric body 31. The second feeder channels 37 are plated in such a way as to connect the first and second radiation patches 34 and 35 with each other. The first and second feeder channels 36 and 37 are connected by soldering to a signal line 13 which functions to provide signals generated by circuit matching, to the ground surface 11 of the printed circuit board 10.

Meanwhile, the first patch element 32, which surrounds the one lengthwise end of the dielectric body 31 formed in the shape of the quadrangular prism, includes a chip-shaped inductor 38. The chip-shaped inductor 38 is positioned in a course through which the first patch element 32 and the ground surface 11 are connected with each other, to provide a ground length increasing effect. As a result, a bandwidth can be expanded up to 10~20%, and, at this time, the chip-shaped inductor 38 can have a value of 5~10 nH.

Due to the fact that, as described above, the antenna according to the present invention employs, by way of the single feeder channel 36, the first and second radiation patches 34 and 35 placed on the upper and lower surfaces of the dielectric body 31, that is, the dual band, operation in the GSM and DCS bands (that is, in the dual band) can be reliably implemented in the mobile communication. Also, because the present microchip dual band antenna is internally mounted to a mobile communication terminal, miniaturization of the terminal is made possible. Further, as the present microchip dual band antenna is surface-mounted to the printed circuit board 10, when a signal is supplied from the signal line 13, not only is a separate feeder line not required, but it is also possible to actively overcome problems related with non-uniform distribution of electric force lines.

The microchip dual band antenna 30 according to the present invention can be used in a personal mobile communication service employing a cellular phone and a PCS phone, a wireless local looped (WLL) service, a future public land mobile telecommunication service (FPLMTS), and radio communication including satellite communication, so that it can be easily adapted to transmission and receipt of signals between a base station and a portable terminal.

In the conventional art, since the microstrip stacked antenna belongs, in its inherent characteristic, to a resonance antenna, disadvantages are caused in that a frequency bandwidth is considerably decreased to several percents and a radiation gain is low. Due to this low radiation gain, because a plurality of patches must be arrayed or stacked one upon another, a size and a thickness of the antenna cannot but be increased. For this reason, when the conventional microstrip stacked antenna is mounted to a personal portable terminal, or used as an antenna for a portable communication transmitter or in radio communication equipment, etc., difficulties are caused.

However, in the present invention, the microchip dual band antenna 30 has a wide frequency bandwidth and a decreased leakage current, whereby a high gain is obtained. In particular, as a VSWR is improved and a size of the antenna is decreased, miniaturization of various radio communication equipment is made possible.

Hereafter, characteristics of the microchip dual band antenna 30 according to the present invention, which is utilized as stated above, will be described in detail.

Figure 6:
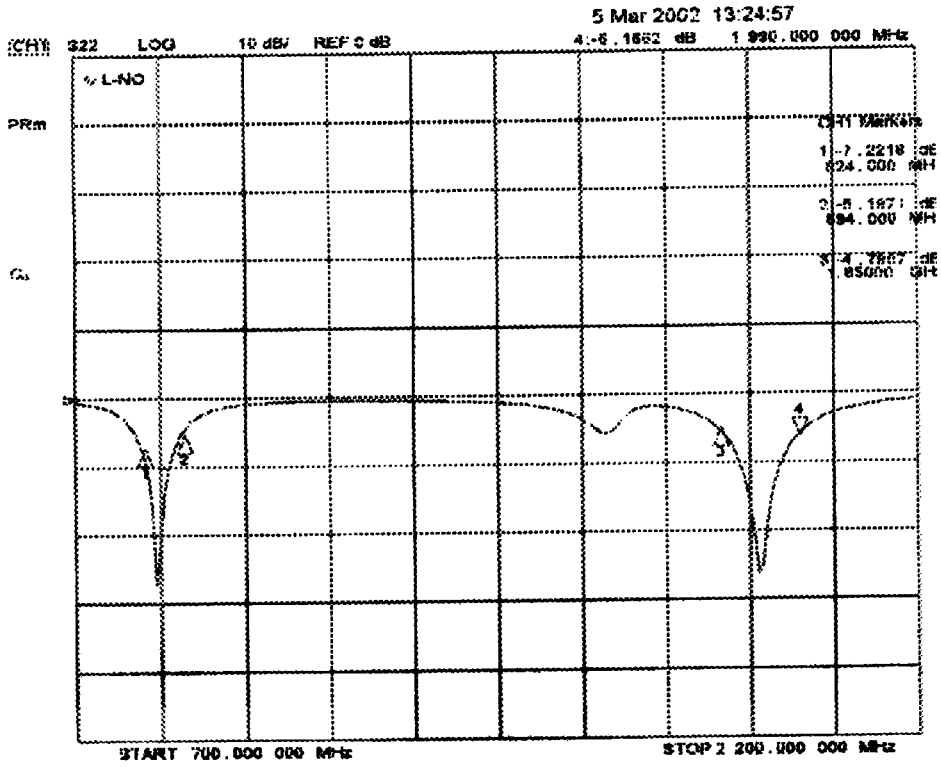
FIG. 6 is a graph illustrating a relationship between a frequency and a return loss in a microchip dual band antenna in accordance with an embodiment of the present invention.
Figure 7:
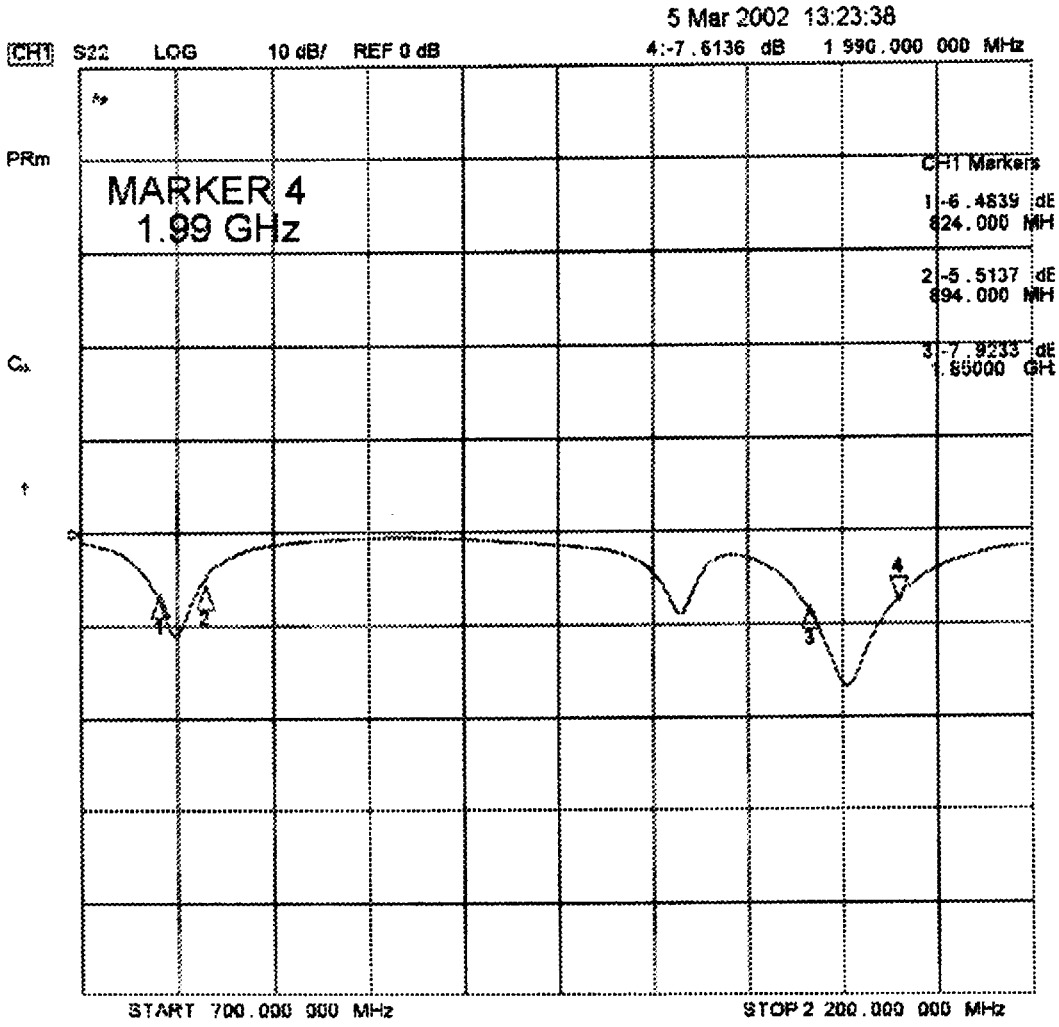
FIG. 7 is a graph illustrating a relationship between a frequency and a return loss in a microchip dual band antenna in accordance with another embodiment of the present invention.

FIG. 6 is a graph illustrating a relationship between a frequency and a return loss in a microchip dual band antenna 30 in accordance with an embodiment of the present invention; and FIG. 7 is a graph illustrating a relationship between a frequency and a return loss in a microchip dual band antenna 30 in accordance with another embodiment of the present invention.

As shown in FIG. 6, a service band of the microchip dual band antenna 30 according to the present invention is realized as a dual band including 824~894 MHz (see Marker 1~Marker 2) by the first radiation patch 34 and 1,850~1,990 MHz (see Marker 3~Marker 4) by the second radiation patch 35. In the case that the chip-shaped inductor 38 is added to the microchip dual band antenna 30, as shown in FIG. 7, in the dual band including 824~894 MHz by the first radiation patch 34 and 1,850~1,990 MHz by the second radiation patch 35, a return loss is improved by 10~20%.

Figure 8:
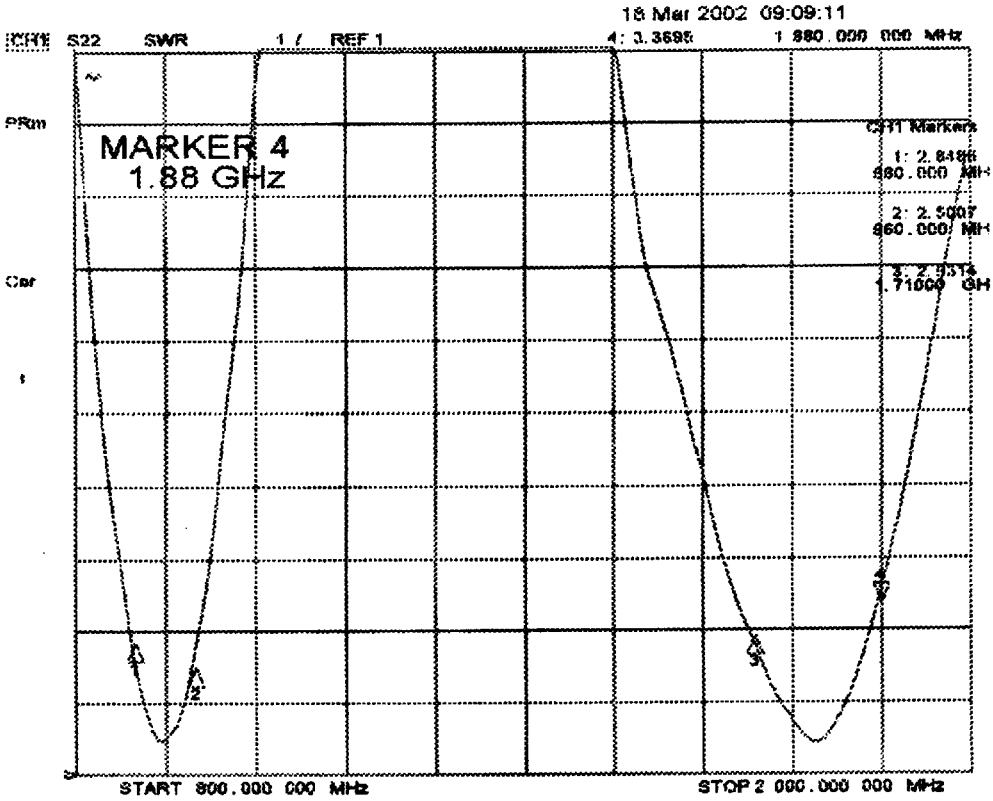
FIG. 8 is a graph illustrating a relationship between a frequency and a voltage standing wave ratio (VSWR) in a microchip dual band antenna in accordance with another embodiment of the present invention.

FIG. 8 is a graph illustrating a relationship between a frequency and a VSWR in a microchip dual band antenna 30 in accordance with another embodiment of the present invention, to which the chip-shaped inductor 38 is added. As can be readily seen from FIG. 8, in an operating frequency band of the GSM, a maximum VSWR of 1:2.5007~2.8486 is obtained with a resonance impedance of 50Ω, and in an operating frequency band of the DCS, a maximum VSWR of 1:2.9314~3.3695 is obtained with a resonance impedance of 50Ω.

That is to say, when assuming that 1 is an ideal VSWR value in the microchip dual band antenna 30, in the Marker 1 included in the GSM band, a VSWR of 2.8486 is obtained at a frequency of 880 MHz, and in the Marker 2, a VSWR of 2.5007 is obtained at a frequency of 960 MHz. In the Marker 3 included in the DCS band, a VSWR of 2.9314 is obtained at a frequency of 1,710 MHz, and in the Marker 4, a VSWR of 3.3695 is obtained at a frequency of 1,880 MHz. As a consequence, it is to be readily understood that excellent VSWRs are obtained in the GSM and DCS bands with respect to the resonance impedance of 50Ω.

Figure 9:
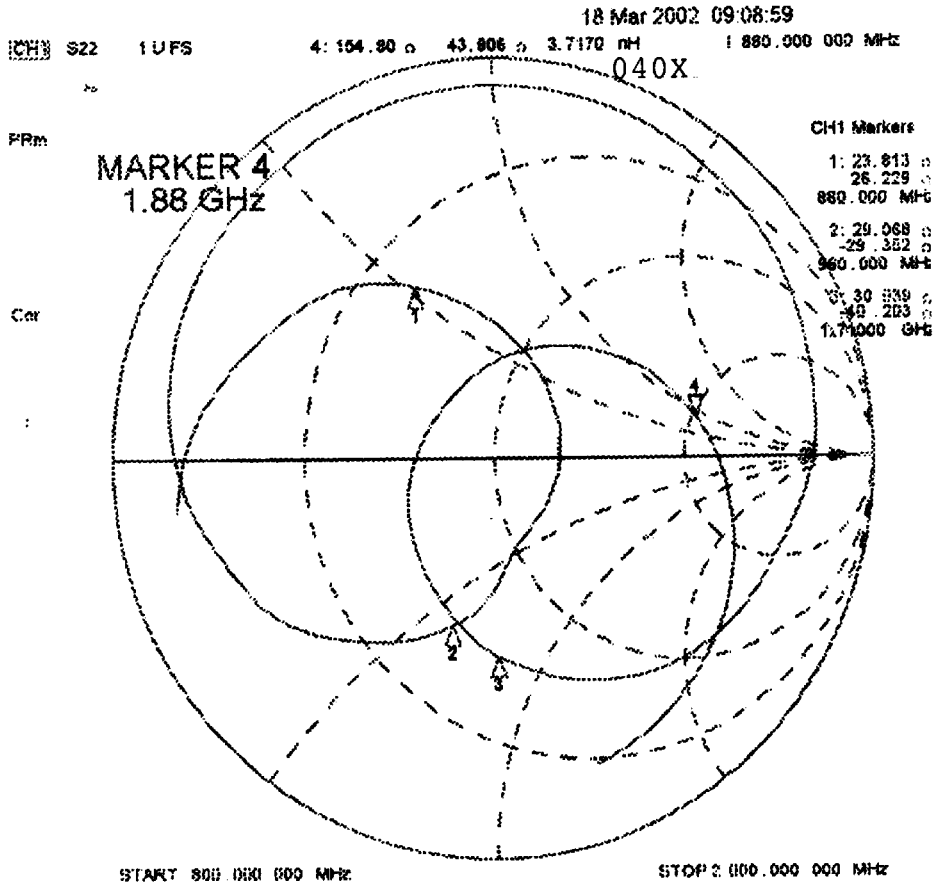
FIG. 9 is a Smith chart explaining a microchip dual band antenna in accordance with another embodiment of the present invention.

FIG. 9 is a Smith chart explaining a microchip dual band antenna 30 in accordance with another embodiment of the present invention, to which the chip-shaped inductor 38 is added.

As shown in FIG. 9, when the resonance impedance of 50Ω is taken as a reference in the GSM and DCS frequency bands, in the Marker 1 included in the GSM band, a resonance impedance of 23.813Ω is obtained at the frequency of 880 MHz, and in the Marker 2, a resonance impedance of 29.068Ω is obtained at the frequency of 960 MHz. Also, in the Marker 3 included in the DCS band, a resonance impedance of 30.939Ω is obtained at the frequency of 1,710 MHz, and in the Marker 4, a resonance impedance of 154.80Ω is obtained at the frequency of 1,880 MHz. As a result, in the GSM band, an entire resonance impedance of 23.813~29.068Ω is realized, and in the DCS band, an entire resonance impedance of 30.939~154.80Ω is realized. Therefore, the present antenna 30 can reliably operate in the dual band situation.

Figure 10:
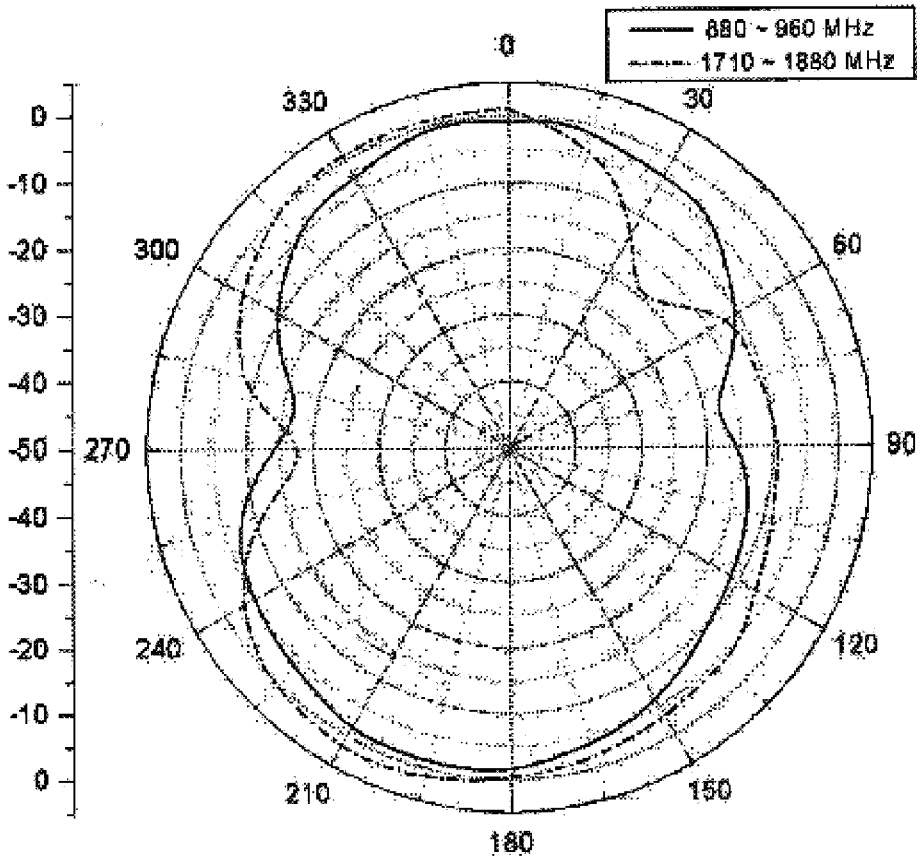
FIG. 10 is a chart explaining a vertical radiation pattern of a microchip dual band antenna in accordance with still another embodiment of the present invention.
Figure 11:
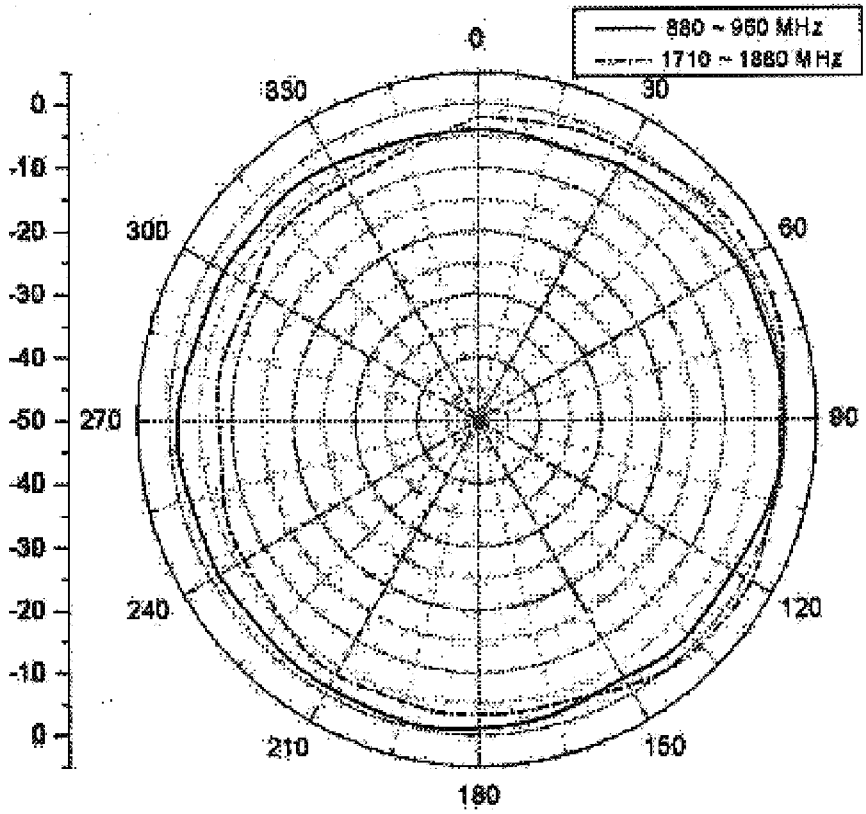
FIG. 11 is a chart explaining a horizontal radiation pattern of a microchip dual band antenna in accordance with yet still another embodiment of the present invention.

FIG. 10 is a chart explaining a vertical radiation pattern of a microchip dual band antenna 30 in accordance with still another embodiment of the present invention. When measured in an anechoic chamber, a radiation gain of 0 dBi is obtained in the GSM band, and a radiation gain of 2 dBi is obtained in the DCS band. Thus, it is to be appreciated that radiation can be effected in portable mobile communication in a more efficient manner. FIG. 11 is a chart explaining a horizontal radiation pattern of a microchip dual band antenna 30 in accordance with yet still another embodiment of the present invention. In FIG. 11, the horizontal radiation pattern is realized as an omnidirectional radiation pattern. Hence, transmission and receipt of signals can be implemented irrespective of a position, whereby a direction-related problem can be effectively solved. At this time, measurement for the microchip dual band antenna 30 according to the present invention is executed in an anechoic chamber having no electrical obstacle or in a field having no obstacle within 50 m in each of forward and rearward directions. In this regard, in the present invention, measurement was executed in the anechoic chamber. By measuring radiation patterns on a main electric field surface and a main magnetic field surface of each Marker point, it was found that radiation patterns on the main electric field surface and main magnetic field surface at each measuring frequency reveal omnidirectional characteristics. Therefore, the microchip dual band antenna according to the present invention can be suitably used as an antenna for transmission and receipt of signals in both of the GSM and DCS bands.

As apparent from the above description, the microchip dual band antenna according to the present invention can achieve a return loss no greater than −5 dB in a dual band, that is, a GSM band and a DCS band. A sufficient VSWR of 1:2.5007~2.8486 is obtained in an operating frequency band of the GSM, and also, a sufficient VSWR of 1:2.9314~3.3695 is obtained in an operating frequency band of the DCS. Resonance impedances of 23.813~29.068Ω and 30.939~154.80Ω are obtained in the GSM and DCS bands, respectively. Vertical radiation patterns of 0 dBi and 2 dBi are obtained in the GSM and DCS bands, respectively. A horizontal radiation pattern is effected in all directions. The microchip dual band antenna can be easily mounted to a printed circuit board. Further, the microchip dual band antenna according to the present invention can be used in a personal mobile communication service employing a cellular phone and a PCS phone, a WLL service, an FPLMTS, an IMT-2000, and radio communication including satellite communication, so that it can be easily adapted to transmission and receipt of signals between portable terminals and in a wireless LAN.

In particular, the microchip dual band antenna according to the present invention provides advantages in that, since a dual band can be realized using a single feeder channel, leakage current is decreased to obtain a high gain and a VSWR is improved, the microchip dual band antenna can be internally mounted to various radio communication equipment in a miniaturized state.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A microchip dual band antenna mounted to a printed circuit board having a ground surface and a non-ground surface, comprising:

first and second patch elements respectively surrounding both lengthwise ends of a dielectric body having a shape of a quadrangular prism;

a first radiation patch separated from the first patch element and placed on an upper surface of the dielectric body to extend zigzag toward the second patch element;

a second radiation patch joined to the second patch element and placed on a lower surface of the dielectric body to extend zigzag toward the first patch element by a distance less than one half of an entire length of the dielectric body, in a manner such that zigzag configurations of the first and second radiation patches are staggered with each other; and a first feeder channel defined on a front surface and adjacent to one end of the dielectric body and plated in such a way as to connect the first and second radiation patches.

2. The microchip dual band antenna as set forth in claim 1, further comprising:

a chip-shaped inductor positioned in a course through which the first patch element and the ground surface are connected with each other, to provide a ground length increasing effect and thereby expand a bandwidth.

3. The microchip dual band antenna as set forth in claim 1, further comprising:

at least one second feeder channel defined on the front surface and adjacent to the other end of the dielectric body and plated in such a way as to connect the first and second radiation patches.

* * * * *